US007596977B2

(12) United States Patent
Eychenne et al.

(10) Patent No.: US 7,596,977 B2
(45) Date of Patent: Oct. 6, 2009

(54) KEY HOUSING

(75) Inventors: Michel Eychenne, Savigny le Temple (FR); Louis Canard, Nevers (FR)

(73) Assignee: Valeo Securite Habitacle, Creteil Cedex (FR)

( * ) Notice: Subject to any disclaimer, the term of this patent is extended or adjusted under 35 U.S.C. 154(b) by 0 days.

(21) Appl. No.: 10/547,007

(22) PCT Filed: Feb. 13, 2004

(86) PCT No.: PCT/FR2004/050125

§ 371 (c)(1),
(2), (4) Date: Aug. 25, 2005

(87) PCT Pub. No.: WO2004/076783

PCT Pub. Date: Sep. 10, 2004

(65) Prior Publication Data

US 2006/0150696 A1 Jul. 13, 2006

(30) Foreign Application Priority Data

Feb. 28, 2003 (FR) ..... 03 02665
Jul. 2, 2003 (FR) ..... 03 08048

(51) Int. Cl.
*A44B 15/00* (2006.01)

(52) U.S. Cl. ..... 70/257; 70/396; 70/399; 70/408; 70/456 R; 206/37.4

(58) Field of Classification Search ..... 70/456 R, 70/257, 408, 459, 396, 399; 24/3.6; 206/37.1–37.8, 206/38.1

See application file for complete search history.

(56) References Cited

U.S. PATENT DOCUMENTS 807,402 A * 12/1905 Scanlan ..... 221/141
1,579,017 A * 3/1926 Marymont ..... 206/37.6
1,599,920 A * 9/1926 Pryor ..... 224/163
1,999,290 A * 4/1935 Goessling ..... 206/37.8
2,078,325 A * 4/1937 Hallock ..... 224/221
2,226,969 A * 12/1940 Onofrio ..... 24/3.5
2,274,820 A * 3/1942 Bills ..... 70/456 R
2,453,190 A * 11/1948 Boscowitz ..... 63/1.12
2,462,206 A * 2/1949 Magee ..... 206/37.8
2,684,096 A * 7/1954 Snell ..... 206/37.8
2,790,319 A * 4/1957 Brunner ..... 70/456 R
2,795,128 A * 6/1957 Ly ..... 70/456 R
2,964,937 A * 12/1960 Lautin ..... 70/456 R
3,682,216 A * 8/1972 Nelson ..... 150/106
3,765,201 A * 10/1973 Humphrey ..... 70/456 R (Continued)

FOREIGN PATENT DOCUMENTS

DE 39 02 537 A1 8/1990

(Continued)

*Primary Examiner*—Lloyd A Gall
(74) *Attorney, Agent, or Firm*—Osha • Liang LLP

(57) ABSTRACT

The invention relates to a key housing with an emergency key, having a key head forming a grip part joined to an insert for insertion in an emergency lock in a vehicle when applied and an insert housing with a longitudinal form, for housing the insert when the emergency key is not in use. The emergency key can be separated from the housing if the emergency key is to be used. The key head is fixed to the insert by of a joint.

9 Claims, 4 Drawing Sheets

U.S. PATENT DOCUMENTS

| | | | | | |
|---|---|---|---|---|---|
| 3,774,423 | A | * | 11/1973 | Orr | 70/375 |
| 4,004,325 | A | * | 1/1977 | Hubachek | 24/3.6 |
| 4,312,200 | A | * | 1/1982 | Thomas | 70/408 |
| 4,489,770 | A | * | 12/1984 | Reich, II | 206/320 |
| 4,637,238 | A | * | 1/1987 | Uda et al. | 70/456 R |
| 4,947,662 | A | * | 8/1990 | Imedio | 70/395 |
| 5,421,180 | A | * | 6/1995 | Rojdev | 70/456 R |
| 5,440,910 | A | * | 8/1995 | Florian | 70/456 R |
| 5,541,571 | A | * | 7/1996 | Ochs et al. | 340/5.62 |
| 5,544,510 | A | * | 8/1996 | Botteon et al. | 70/456 R |
| 5,561,331 | A | * | 10/1996 | Suyama et al. | 307/10.3 |
| 5,704,235 | A | * | 1/1998 | Stahle | 70/456 R |
| 5,799,522 | A | * | 9/1998 | Ohta | 70/456 R |
| 6,216,501 | B1 | * | 4/2001 | Marquardt et al. | 70/252 |
| 6,386,007 | B1 | * | 5/2002 | Johnson et al. | 70/408 |
| 6,460,386 | B1 | * | 10/2002 | Watanuki et al. | 70/456 R |
| 6,460,698 | B1 | * | 10/2002 | Wang | 206/234 |
| 6,474,123 | B1 | * | 11/2002 | Kito et al. | 70/456 R |
| 6,647,752 | B1 | * | 11/2003 | Chaillie | 70/456 R |
| 6,729,518 | B2 | * | 5/2004 | Badillo et al. | 224/578 |
| 6,763,938 | B1 | * | 7/2004 | Nelson | 206/37.1 |
| 2002/0100784 | A1 | * | 8/2002 | Baird | 224/679 |
| 2003/0164014 | A1 | * | 9/2003 | Matsushita et al. | 70/456 R |

FOREIGN PATENT DOCUMENTS

| | | | | |
|---|---|---|---|---|
| EP | 0987389 | | * | 3/2000 |
| EP | 1 040 772 | A1 | | 10/2000 |
| EP | 1 164 236 | A | | 12/2001 |
| FR | 2 816 976 | A | | 5/2002 |

* cited by examiner

KEY HOUSING

FIELD OF THE INVENTION

The present invention relates to a key casing, particularly for a motor vehicle, exhibiting a key, particularly a back-up key, comprising, on the one hand, a key bow part and an insert and, on the other hand, an insert housing to accommodate the insert when the key is not being used.

BACKGROUND OF THE INVENTION

In the field of automotive engineering the document EP 0 987 389 in the name of the Applicant company, for example, discloses key casings comprising an electronic part used to identify a user of the vehicle through the exchange of electromagnetic signals, and a mechanical part containing a back-up key.

Such casings are particularly practical because they allow the key to be concealed within the actual structure of the casing which protects it. This is highly advantageous because the user needs this back-up key only in the event of an electrical failure, for example if the battery in the electronic part is dead or the vehicle battery fails.

This arrangement also prevents the key insert from catching in the user's pockets and damaging his or her clothing. This arrangement furthermore allows the size of the casing to be reduced significantly.

In the above-mentioned document EP 0 987 389, the back-up key comprises a bow part forming a part for holding and a metal insert which can be used as a back-up mechanical key, the bow part being fixed rigidly perpendicular to the metal insert.

In order to accommodate this back-up key, the casing comprises, along one of its edges, a housing forming a sleeve intended to accommodate the insert and the bow part of the key is clipped onto a corresponding opening of the casing.

However, given that the number of functions performed by the electronic part is constantly increasing, entailing more numerous electronic components, it is necessary to reduce the size of the back-up insert as far as possible.

Additionally, given that there is no hermetic separation between the electronic part and the mechanical part, special-purpose sealing means needs to be provided, and this tends to increase the cost of the casing.

The present invention aims to alleviate these various disadvantages by proposing a key casing comprising a key, particularly a back-up key, having a smaller size.

SUMMARY OF THE INVENTION

To this end, the invention proposes a key casing, particularly for a motor vehicle, comprising:

- a key, particularly a back-up key, comprising, fixed together, a key bow part forming a part for holding and an insert intended to be inserted in a lock, particularly a back-up lock, of a vehicle in the event of its being used, and
- an insert housing of longitudinal shape, intended to accept the insert when the key is not being used, it being possible for the key to be separated from the casing in the event of its being used, characterized in that the key bow part is fixed to the insert by an articulation.

The casing according to the invention may further comprise one or more of the following characteristics:

- the insert is produced in the form of a metal insert or alternatively in the form of a plastic insert,
- the axis of articulation is perpendicular to a plane defined by the insert and the key bow part and may be positioned perpendicular to the axis associated with the width of the insert or perpendicular to the axis associated with the thickness of the insert,
- the articulation is produced in such a way that the key bow part can be moved between a position of rest in which it is more or less parallel to the key insert and a position of use in which it is more or less perpendicular to the key insert,
- the articulation is provided with means for indexing the rest and use positions,
- the articulation comprises a plastic end-piece overmolded onto the rear end of the insert and bearing two diametrically opposed pegs, these two pegs collaborating with corresponding orifices belonging to the key bow part so as to allow the key bow part to pivot with respect to the insert,
- the key bow part has at least one slot allowing translational movement of the pegs that form the articulation along this slot at the same time as or not at the same time as the key bow part pivots with respect to the insert so as to configure the key bow part in the rest position,
- the parts of the articulation borne, on the one hand, by the key bow part and, on the other hand, by the insert are assembled by clipping together,
- the key bow part comprises, at the articulation, a concave part intended to collaborate with a finger of a user so as to extract the key from its housing,
- the casing comprises additional clipping-together means borne, on the one hand, by the key bow part and, on the other hand, by the key casing so as to secure the key in the casing,
- the key bow part comprises, at its opposite end to the articulation, a grasping notch intended to collaborate with a finger of a user so as to extract the key from its housing and manipulate the key bow part,
- in its position of rest inserted in its housing in the casing, the key bow part forms part of the external wall of the casing,
- the casing comprises a housing for the electronics, which is hermetically separated from the housing for the key.

BRIEF DESCRIPTION OF THE DRAWINGS

Further characteristics and advantages of the invention will become apparent from the description which follows, given by way of example, without implied limitation, with reference to the attached drawings in which.

DETAILED DESCRIPTION OF THE INVENTION

Figure 1:
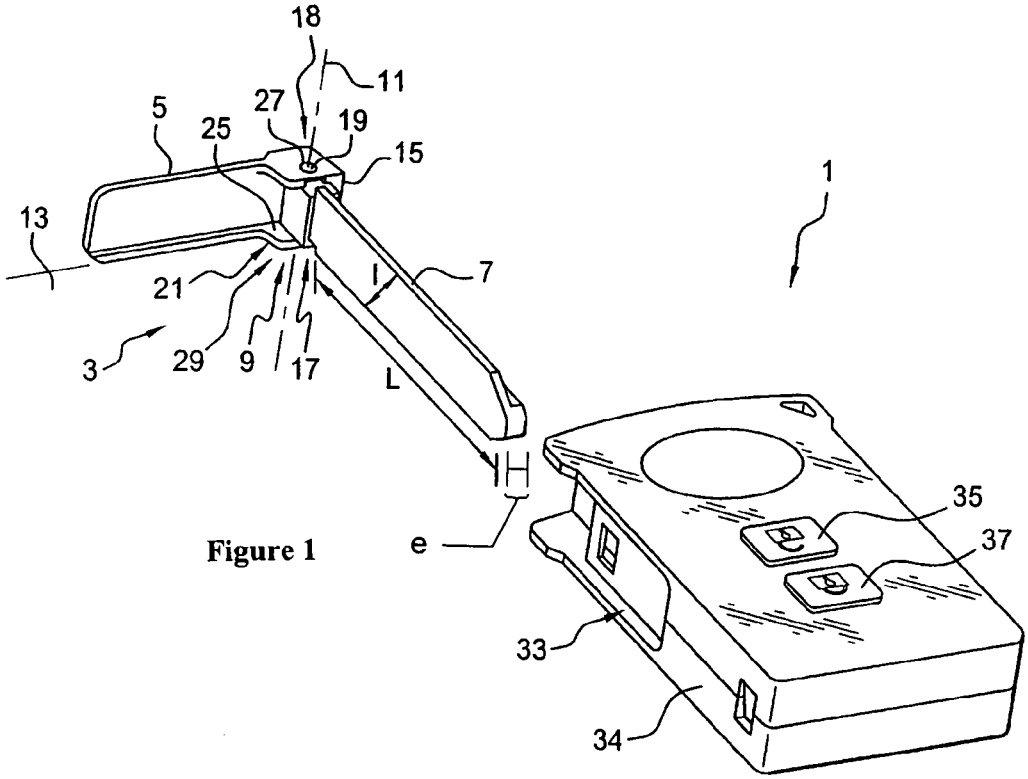
FIG. 1 is a perspective view of a casing according to the invention with the back-up key extracted.
Figure 2:
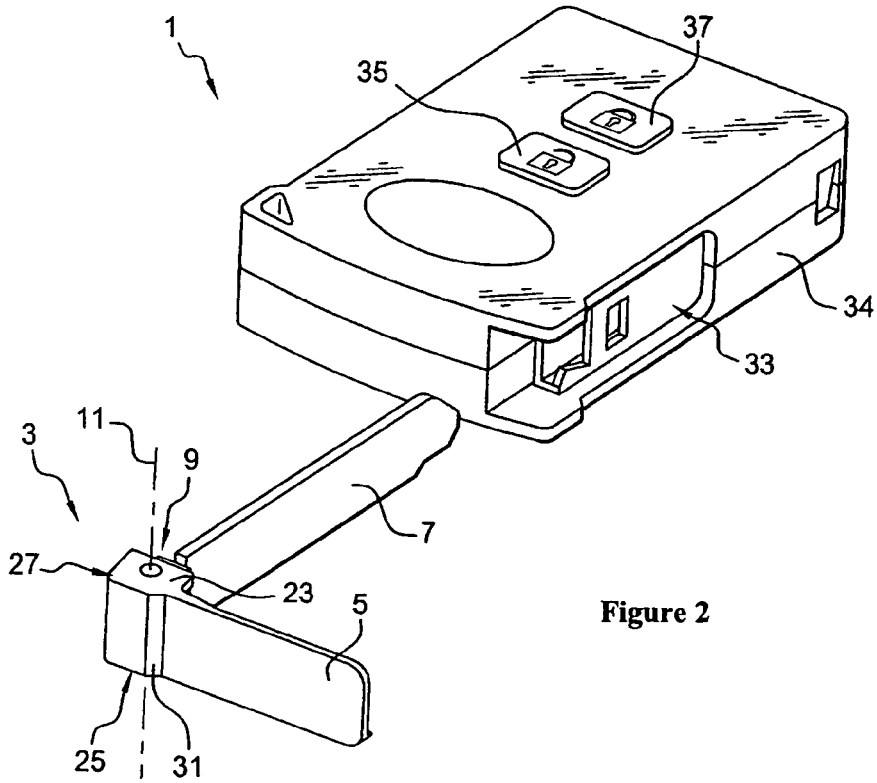
FIG. 2 is a perspective view of the casing from a different angle, with the back-up key extracted.
Figure 3:
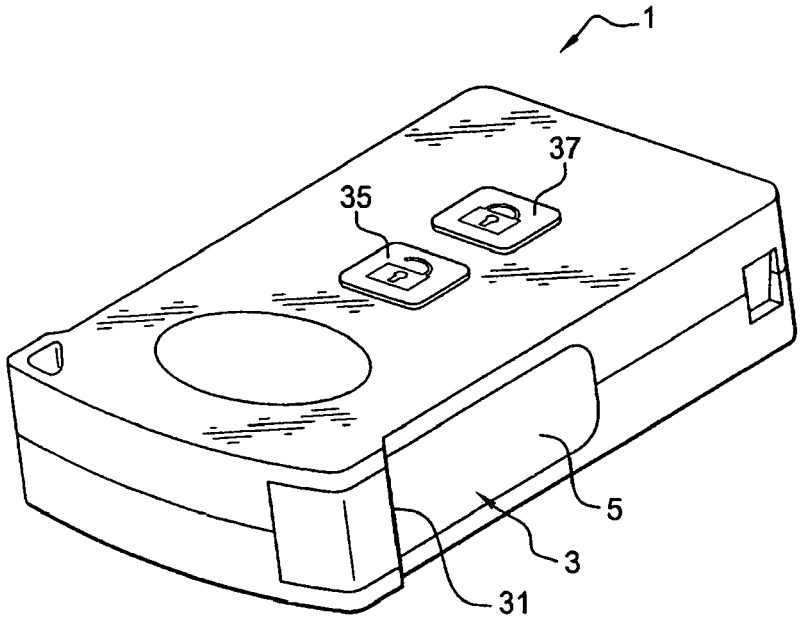
FIG. 3 is a perspective view of the casing from the same angle as FIG. 2, assembled with the back-up key in the rest position.

FIGS. 1 to 3 show perspective views of the key casing 1 according to the invention, from various angles, and of its key, particularly a back-up key, 3.

The key, particularly a back-up key, 3, comprises, fixed together, a key bow part 5 forming a part for holding and an insert 7 having a longitudinal axis and intended to be inserted in a back-up lock (not depicted) of a vehicle in the event of its being used.

The geometry of the key insert, similar to an elongate blade, allows a length (L), a width (I) and a thickness (e) of the insert to be defined, together with associated axes running in these various directions.

In the embodiment described hereinafter, the insert 7 is a back-up insert produced in the traditional form of a metal insert but, for economic purposes, the insert could equally be produced in the form of a plastic insert.

According to one aspect of the invention, the key bow part 5 is fixed to the insert 7 by an articulation 9.

Thus, the key bow part 5 can be moved between a rest position (FIG. 3) in which it is more or less parallel to the key insert 7 and a position of use (FIGS. 1 and 2) in which it is more or less perpendicular to the longitudinal axis of the key insert 7.

As a preference, the axis 11 of pivoting of the articulation 9 is perpendicular to a plane 13 defined by the longitudinal axis of the insert and the key bow part in the position of use.

To make it more convenient for the user and give the back-up key 3 greater stability, particularly in the position of use, the articulation 9 is provided with means (not depicted) for indexing the rest and use positions.

Advantageously, the articulation 9 comprises a plastic end-piece 15 overmolded onto the rear end 17 of the insert and bearing two pegs, 19 and 21 respectively, which are diametrically opposed.

The rear end 18 of the key bow part 5 comprises two walls 23 and 25 parallel to the plane 13 and provided with orifices 27 and 29.

These two walls 23 and 25 enclose the plastic end-piece 15.

The two pegs 19 and 21 form the axis 11 of pivoting and collaborate with the corresponding orifices 27 and 29 in the key bow part 5.

As visible in FIGS. 1 and 2, the axis 11 of pivoting is orthogonal to the longitudinal axis of the insert and parallel to an axis running along the width (1) of the insert.

In order to assemble the key bow part 5 with the metal insert 7, the walls 23 and 25 are made with a thickness and a material that is flexible enough for them to be parted slightly to allow the end-piece 15 to be fitted.

According to another advantageous variant that has not been depicted, the parts of the articulation 9 that are borne, on the one hand, by the key bow part 5 and, on the other hand, by the insert 7 are assembled by clipping together.

To make it easier to separate the back-up key from the casing, the key bow part 5 comprises, at the articulation 9, a concave part 31 intended to collaborate with a finger of a user.

When it is not in use, the back-up key 3 needs to be folded in such a way that the key bow part 5 and the insert 7 are more or less parallel to one another and needs to be fixed, preferably, by additional clipping-together means borne, on the one hand, by the key bow part and, on the other hand, by the key casing 1, in said casing.

For this, the casing 1 comprises an insert housing 33 of longitudinal shape, intended to accommodate the metal insert 7 when the back-up key 3 is not in use. This housing 33 is partially covered by the external wall 34 of the casing.

As can be seen in FIG. 3, when the back-up key 3, in the rest position, namely in the folded position, is inserted in its housing in the casing 1, the key bow part 5 forms part of the external wall 34 of the casing 1.

Finally, the casing 1 comprises a housing (not visible) for the communication electronics. These communication electronics comprise, for example, a transponder and/or a remote control, or alternatively radiofrequency communications electronics of the hands-free type. The figures depict, by way of example, two remote-control buttons 35 and 37 for locking and unlocking the vehicle.

Advantageously, the housing for the electronics is hermetically separated from the housing for the back-up key. This may, for example, be achieved by hermetically welding together two half-shells to form a casing once the board carrying the electronic components has been positioned in one of the half-shells.

The key casing is simple and pleasant for a vehicle user to use.

Specifically, when the casing 1 and the back-up key 3 are assembled as depicted in FIG. 3, all that is required is for pressure to be exerted in the concave part 31 in order to extract the back-up key 3. The back-up key is then completely separated from the casing 1.

Next, the key bow part 5 is deployed relative to the insert 7 simply by pivoting about the axis 11 and can be inserted in a back-up lock of the vehicle and operate this lock.

Figure 4:
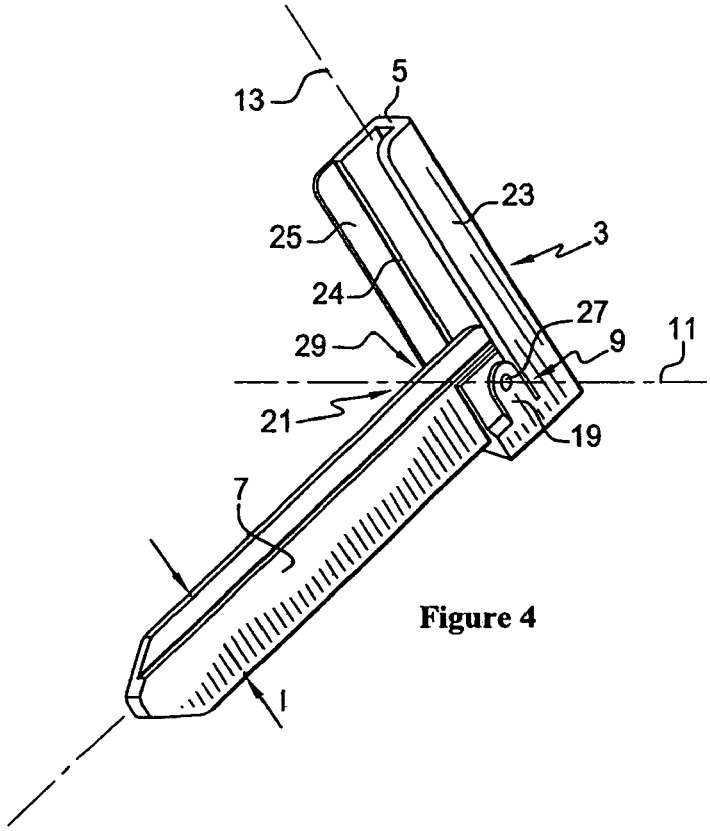
FIG. 4 is a perspective view of an extracted back-up key according to a second embodiment of the invention.
Figure 5:
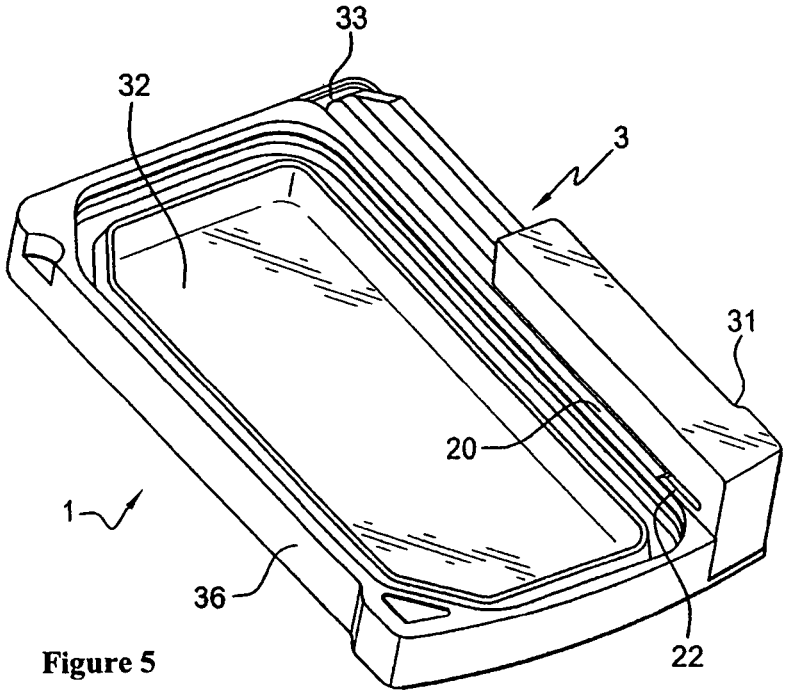
FIG. 5 is a view of the bottom casing shell of the key casing in which casing shell the back-up key is positioned in the rest position according to the second embodiment of the invention.

FIGS. 4 and 5 depict a second embodiment of the invention which depicts the key bow part and its insert in the position of use and part of the key casing accommodating the key bow part and its insert in the rest or folded position.

References identical to the first embodiment are indicated by the same numerals.

As visible in FIG. 4, the key bow part 5 is fixed to the insert 7, in the example described produced in the form of a metal insert, by the articulation 9 such that the key bow part 5 can be moved between a position of rest in which it is more or less parallel to the key insert 7 and a position of use (FIG. 4) in which it is more or less perpendicular to the longitudinal axis of the key insert.

In the position of use, just as in the first embodiment depicted in FIGS. 1 and 2, the axis 11 of pivoting of the articulation 9, or axis of articulation, is perpendicular to the plane 13 defined by the longitudinal axis of the insert and the key bow part in the position of use. However, here, the axis of articulation 11 is orthogonal to an axis corresponding to the width (1) of the insert.

This characteristic arrangement of the axis 11 of pivoting is particularly advantageous because it allows the articulation 9 forming the key bow part/insert connection to be very robust.

As in the previous embodiment, the articulation 9 comprises a plastic end-piece 15 overmolded onto the rear end 17 of the insert 7 and bearing two pegs, 19 and 21 respectively, that are diametrically opposed and form the axis 11 of pivoting.

The rear end 17 of the key bow part 5 comprises two walls 23 and 25 parallel to the plane 13, enclosing the plastic end-piece 15 and provided with orifices 27 and 29 in which the two pegs 19 and 21 respectively engage.

When it is not being used, the back-up key 3 is folded so that the key bow part 5 and the insert 7 are more or less parallel with respect to one another and held in the rest position by additional clipping-together means 20, 22 borne, on the one hand, by the key bow part and, on the other hand, by the key casing, in the casing 1.

As a preference, the walls 23 and 25 extend along the longitudinal axis of the key bow part 5 and exhibit positioning grooves 24 to ensure correct positioning of the insert 7 when the insert is folded parallel to the key bow part in the position of rest.

The insert 7 may be assembled with the key bow part 5 in a way similar to the one described in the context of the first embodiment of the invention.

As set out in FIG. 5, when the key 3 is in the position of rest, it can be stored in the insert housing 33 exhibited, for example, by the lower half-shell 36 of the key casing. This insert housing 33 is of longitudinal shape and is intended to be partially covered by the external wall (not depicted) of the casing, which wall is formed by the lower half-shell 36 and the upper half-shell (not depicted) of the casing when these half-shells are assembled.

The lower half-shell 36 comprises a housing 32 for communications electronics (not depicted) which comprise, for example, a transponder and/or a remote control, or alternatively radiofrequency communications electronics of the hands-free type.

To make it easier to separate the back-up key from the casing, the key bow part 7 comprises, at the articulation 9, a concave part 31 intended to collaborate with a finger of a user.

Furthermore, it is also possible to provide, at the key bow part 5, at its opposite end to the articulation 9, a grasping notch intended to collaborate with a finger of a user so as to manipulate the key bow part 5.

Figure 6:
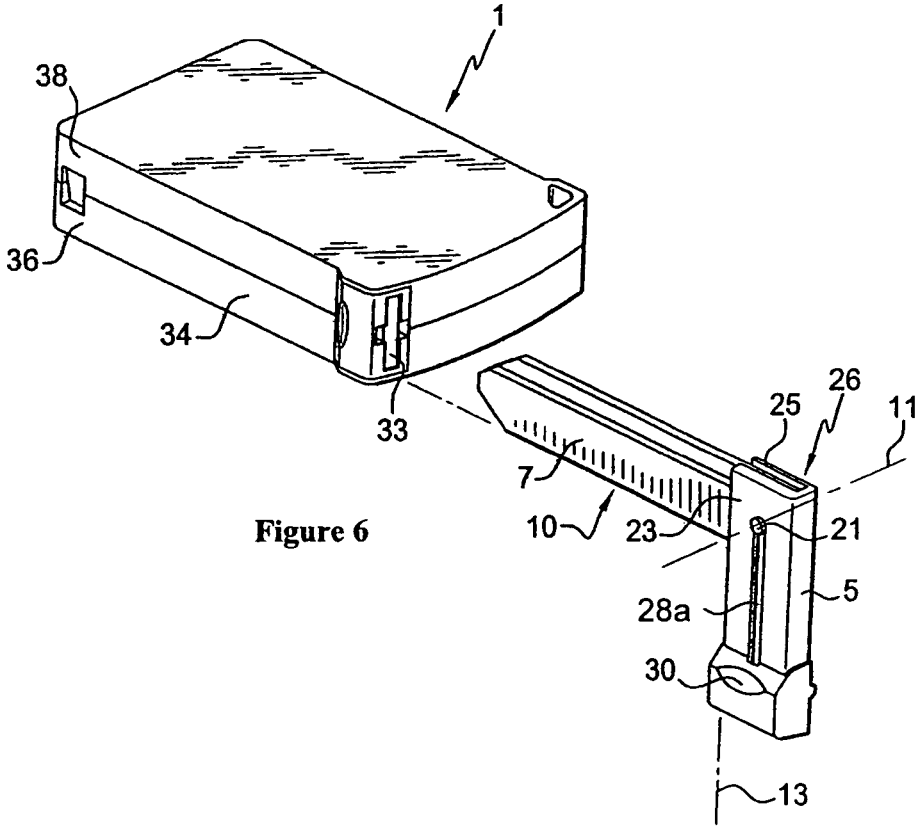
FIG. 6 is a perspective view of a casing according to a third embodiment of the invention with the back-up key extracted and in the position of use.
Figure 7:
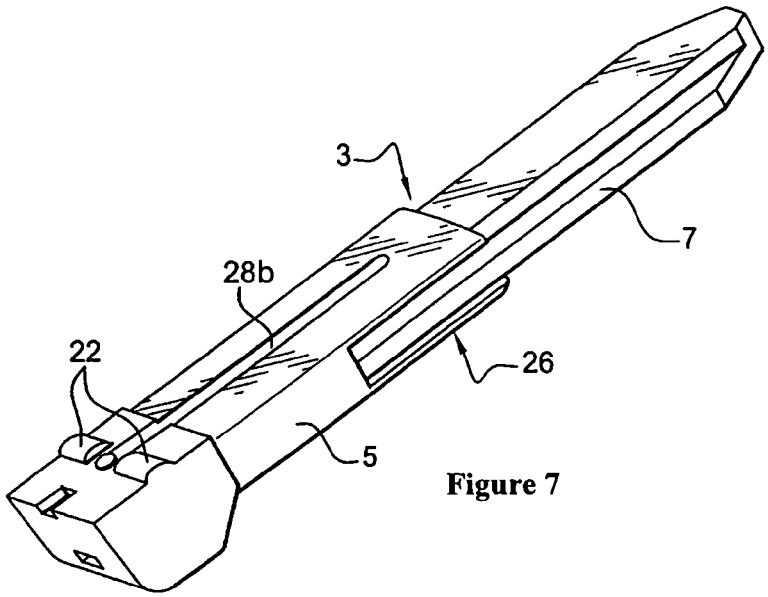
FIG. 7 is a perspective view of a back-up key in the position of rest according to the third embodiment of the invention.
Figure 8:
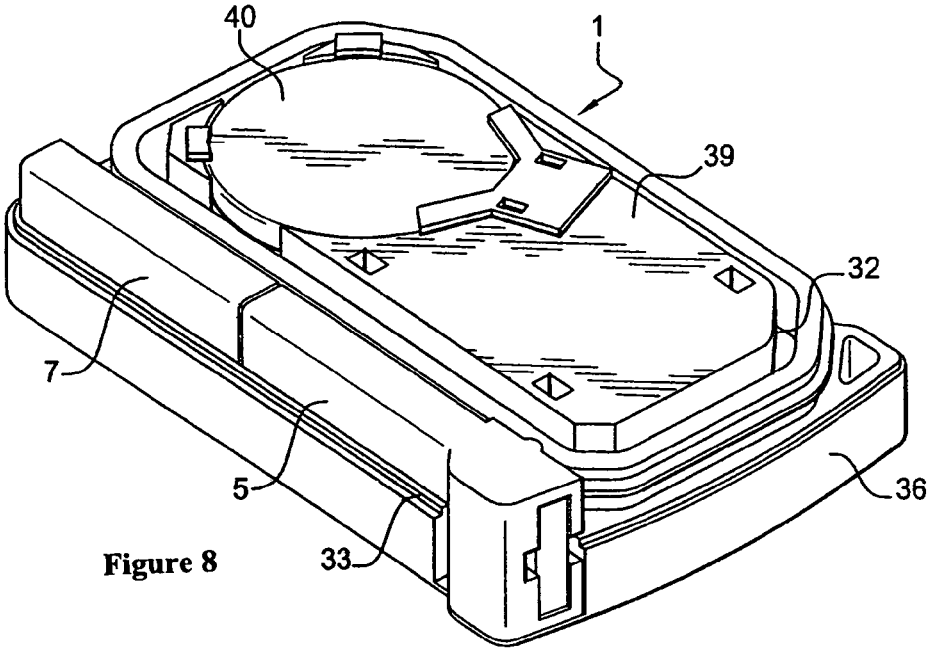
FIG. 8 is a perspective view of part of the key casing housing the back-up key according to the third embodiment of the invention.

A third embodiment of the invention is depicted in FIGS. 6 to 8 which respectively show the casing with its back-up key in the position of use, the back-up key in the rest position and the back-up key in the rest position housed in the lower half-shell of the key casing.

According to one aspect of the invention, the key bow part 5 is fixed to the insert 7, produced in the form of a metal or plastic insert, by an articulation 10 and the key bow part 5 may be moved between a position of rest (FIGS. 7 and 8) in which it is more or less parallel to the longitudinal axis of the key insert 7 and a position of use (FIG. 6) in which it is more or less perpendicular to the longitudinal axis of the key insert 7.

In the position of use, the axis 11 of pivoting of the articulation 10 is perpendicular to a plane 13 defined by the longitudinal axis of the insert and the key bow part in the position of use so that the axis 11 of pivoting is arranged perpendicular to an axis running along the width (I) of the insert.

This characteristic arrangement of the axis of pivoting is particularly advantageous because it allows the articulation 10 forming the key bow part/insert connection to be very robust.

In this embodiment, the key insert 7 and the key bow part 5 are fixed to one another by the articulation 10 which, through its structure, allows the insert 7 and the key bow part 5 to be maneuvered with respect to one another on the one hand in terms of rotation and, on the other hand, in terms of translation.

To this end, the rear end 17 of the insert 7 has an overmolded end-piece 15 provided with pegs 19 and 21 forming the axis 11 of pivoting of the articulation 10 and collaborating with orifices 27, 29 of the key bow part 5.

The key bow part 5 is, for its part, in the shape of a U-shaped component 26 of longitudinal shape which encloses the rear end 17 of the insert 7. The orifices 27, 29 each form a slot 28*a* and 28*b* respectively which runs along the longitudinal axis of the key bow part 5 so that, in collaboration with the pegs 19, 21, these slots allow a translational movement of the articulation 10 along the longitudinal axis of the key bow part 5 with a view to preparing to position the insert 7 in the rest position.

As a preference, the translational and rotational movements of the key bow part 5 with respect to the insert 7 are performed successively, that is to say that the key bow part 5 needs first of all to have been slid from its position of use to an intermediate position in which the pegs 19 and 21 are at the rear end 18 of the key bow part before the key bow part 5 is rotated toward the insert 7 with a view to positioning it in the rest position.

It is also possible to anticipate having an articulation 10 configured to allow the translational and rotational movements of the key bow part 5 with respect to the insert 7 to be performed simultaneously. The axis 11 of pivoting is then able to move and still runs parallel to itself.

According to a practical aspect of the invention, the various parts that make up the articulation 10 and are borne, on the one hand, by the key bow part 5 and, on the other hand, by the insert 7, are assembled by clipping together.

When the key 3 is in the rest position (FIG. 7) it can be housed in an insert housing 33 of longitudinal shape, formed from two housings produced in each of the two half-shells of the key casing 1. This insert housing, once the two half-shells have been assembled, is partially covered by the external wall 34 of the key casing 1. FIG. 8 more specifically shows the key 3 in the rest position, housed in part of the insert housing 33 which part is formed in the lower half-shell 36 of the key casing 1.

The lower half-shell 36 comprises a housing 32 for the communications electronics 39 which comprise, for example, a transponder and/or a remote control or alternatively radiofrequency communications electronics of the hands-free type and is provided with energy-storage means 40. In this instance, the housing 32 for the electronics is separated hermetically from the housing for the back-up key by the presence of sealing means, for example a sealing gasket.

Furthermore, to make it easier to perform the translational movement of the key bow part 5 with respect to the insert 7 or alternatively to make it easier to withdraw the key 3 from its insert housing 33, the key bow part 5 has, at its opposite end to the articulation 10, a grasping notch 30 for the user's fingers (FIG. 6).

When it is not being used, the back-up key 3 needs to be folded, in its rest position, so that the key bow part 5 and the insert 7 are more or less parallel to one anther and needs to be fixed, preferably by additional clipping-together means borne, on the one hand, by the key bow part and, on the other hand, by the key casing, in the casing 1. Clipping-together means 22 borne by the key bow part 5 are depicted in FIG. 7.

Thus, by virtue of the invention, there has been produced a key casing that is particularly simple to use and allows a back-up key to be incorporated.

It will also be understood that the key casing according to the invention advantageously allows the size of the mechanical part to be reduced and allows the housing of a back-up key which may be perfectly serviceable if need be when arranged in its position of use.

Furthermore, by virtue of the invention, the back-up key can be mounted on the casing at a later date, and this has a significant industrial benefit when the facility for manufacturing the electronics and the facility for manufacturing the insert with the corresponding locks are situated at geographically separated locations.

What is claimed is:

1. A key casing comprising:

a vehicle identification communication electronic part comprising at least one of a transponder and a remote control, or alternatively radiofrequency communication electronics of the hands-free type, and an energy storage means, and a vehicle key, comprising:

a key bow part forming a part for holding the key, and an insert configured to be inserted in a lock of a vehicle, wherein the key bow part is fixed to the insert by an articulation, wherein the articulation forms a movable connection between the key bow part and the insert; and a housing comprising an electronics housing which contains the vehicle identification communication electronic part, and an insert housing, wherein the insert housing is of longitudinal shape and is configured to accommodate the insert when the key is not being used, wherein the electronics housing and the insert housing are separated hermetically, and wherein the key is separable from the housing, and wherein the articulation is configured to allow the key bow part to be moved between a position of rest that is substantially parallel to the insert and a position of use that is substantially perpendicular to a longitudinal axis of the insert.

2. The key casing as claimed in claim 1, wherein the insert is a metal insert.

3. The key casing as claimed in claim 1, wherein the insert is a plastic insert.

4. The key casing as claimed in claim 1, wherein an axis of articulation is perpendicular to a plane defined by the insert and the key bow part.

5. The key casing as claimed in claim 4, wherein an axis of articulation is orthogonal to an axis running in a direction of a thickness of the insert.

6. The key casing as claimed in claim 1, wherein the articulation comprises:

a plastic end-piece overmolded onto a rear end of the insert, and two diametrically opposed pegs, wherein the two diametrically opposed pegs are configured to collaborate with corresponding orifices of the key bow part to allow the key bow part to pivot with respect to the insert.

7. The key casing as claimed in claim 1, wherein the key bow part comprises, at the articulation, a concave part configured to collaborate with a finger of a user so as to extract the key from the insert housing.

8. The key casing as claimed in claim 1, further comprising clipping-together means configured to secure the key in the casing.

9. The key casing as claimed in claim 1, wherein the key bow part forms part of an external wall of the casing when the insert is inserted in the insert housing.

* * * * *